US006985090B2

(12) United States Patent
Ebner et al.

(10) Patent No.: US 6,985,090 B2
(45) Date of Patent: Jan. 10, 2006

(54) METHOD AND ARRANGEMENT FOR CONTROLLING A SYSTEM OF MULTIPLE TRAFFIC SIGNALS

(75) Inventors: Andre Ebner, Hamburg (DE); Matthias Lott, Munich (DE); Egon Schulz, Munich (DE); Ruediger Halfmann, Otterberg (DE); Hermann Rohling, Wolfenbüttel (DE)

(73) Assignee: Siemens Aktiengesellschaft, Munich (DE)

( * ) Notice: Subject to any disclaimer, the term of this patent is extended or adjusted under 35 U.S.C. 154(b) by 254 days.

(21) Appl. No.: 10/230,106

(22) Filed: Aug. 29, 2002

(65) Prior Publication Data

US 2003/0063015 A1 Apr. 3, 2003

(30) Foreign Application Priority Data

Aug. 29, 2001 (DE) ..... 101 42 250
Aug. 29, 2001 (EP) ..... 01120587

(51) Int. Cl.
*G08G 1/095* (2006.01)

(52) U.S. Cl. ..... 340/907; 340/906; 340/909; 340/910; 340/915; 340/916; 340/917; 340/988; 340/904; 340/902

(58) Field of Classification Search ..... 340/907, 340/906, 909, 910, 915, 916, 917, 988, 902, 340/904

See application file for complete search history.

(56) References Cited

U.S. PATENT DOCUMENTS

| | | | | | |
|---|---|---|---|---|---|
| 5,014,052 | A | | 5/1991 | Obeck | 340/906 |
| 5,345,232 | A | * | 9/1994 | Robertson | 340/906 |
| 5,539,398 | A | | 7/1996 | Hall et al. | 340/907 |
| 5,926,113 | A | | 7/1999 | Jones et al. | 340/906 |
| 5,955,968 | A | * | 9/1999 | Bentrott et al. | 340/906 |
| 5,973,616 | A | * | 10/1999 | Grebe et al. | 340/825.69 |
| 6,064,319 | A | | 5/2000 | Matta | 340/917 |
| 6,072,406 | A | * | 6/2000 | Leonard et al. | 340/902 |
| 6,326,903 | B1 | * | 12/2001 | Gross et al. | 340/988 |
| 2003/0006909 | A1 | * | 1/2003 | Basson et al. | 340/906 |

FOREIGN PATENT DOCUMENTS

| | | |
|---|---|---|
| DE | 19601024 | 7/1997 |
| DE | 19842912 | 3/2000 |
| DE | 19963942 | 8/2000 |
| EP | 0461860 | 12/1991 |
| EP | 0731431 | 9/1996 |
| JP | 5303700 | 11/1993 |

* cited by examiner

*Primary Examiner*—Daniel Wu
*Assistant Examiner*—Tai Tan Nguyen
(74) *Attorney, Agent, or Firm*—Harness, Dickey & Pierce, P.L.C.

(57) ABSTRACT

A method and arrangement for controlling a system of multiple traffic signals for regulating the traffic of vehicles is described. Traffic data is transmitted by wireless transmission to traffic data processing units assigned individually to a locally limited group of traffic signals, and each traffic data processing unit performs an analysis of the local traffic situation for the environment of the locally limited group of traffic signals up to, at the maximum, the neighboring locally limited groups of traffic signals.

13 Claims, 5 Drawing Sheets

METHOD AND ARRANGEMENT FOR CONTROLLING A SYSTEM OF MULTIPLE TRAFFIC SIGNALS

The present application hereby claims priority under 35 U.S.C. § 119 on German Patent application number 10142250.4 filed Aug. 29, 2001, and European Patent application number 01120587.9 filed Aug. 29, 2001, the entire contents of each of which is hereby herein incorporated by reference.

FIELD OF THE INVENTION

The present invention generally relates to a method of controlling a system of multiple traffic signals for regulating vehicular traffic, whereby traffic data is acquired by the vehicles. Preferably, it may relate to a method wherein traffic data is transmitted at least partially by wireless transmission to traffic data processing units; the traffic situation is analyzed in the traffic data processing units, and the traffic signals are controlled on the basis of the results of this analysis. In addition, the invention generally relates to an arrangement for controlling a system of multiple traffic signals based on traffic data acquired by vehicles, using traffic data processing units. The system may preferably include transceiver equipment which is connected to the traffic data processing units as well as equipment for analyzing the traffic situation in the traffic data processing units and equipment for controlling the traffic signals on the basis of the results of this analysis.

BACKGROUND OF THE INVENTION

A method of controlling traffic lights as a specific type of traffic signal is known from German Patent 196 01 024, for example, which describes the transmission of traffic data, in particular position data determined by GPS, via mobile wireless transmission from vehicles to a central traffic control computer, whereby local traffic control computers may also be connected in between for data acquisition. This central traffic control computer performs a central analysis of the global traffic situation for the overall system of traffic lights, and on the basis of the results of this analysis, it coordinates the local traffic control computers, which in turn control the individual traffic lights. In addition, information may also be transmitted to the vehicle by the traffic control computer to provide assistance for the occupants of the vehicle.

However, one disadvantage of this system is that a relatively complex network of different hierarchies of traffic data processing must be provided, and in particular the central traffic control computer must handle a large volume of data and is therefore expensive accordingly, rapid data processing and data relaying must be guaranteed, and in the event of a fault or error, total failure of the entire system is threatened.

U.S. Pat. No. 5,014,052 describes a method in which special vehicles can instruct traffic lights to allow traffic to pass through by wireless bidirectional communication between these special vehicles (police, fire department, etc.) and a traffic light, and the traffic light sends a confirmation of the communication back to the special vehicle. Additional special vehicles may also be taken into account. However, a more extensive analysis of the general traffic situation is not performed there.

SUMMARY OF THE INVENTION

An object of an embodiment of the present invention is to provide an option for controlling a system of multiple traffic signals, which can be implemented in the simplest possible manner while nevertheless permitting the most comprehensive possible detection of the traffic situation and adaptation of the control to the traffic situation.

An embodiment of the present invention includes a method of controlling a system of multiple traffic signals for regulating the traffic of vehicles, whereby traffic data is acquired by the vehicles. The traffic data is transmitted to traffic data processing units at least partially via wireless transmission. In the traffic data processing units, the traffic situation is analyzed and the traffic signals are controlled on the basis of the result of this analysis. According to the embodiment, traffic data is transmitted by wireless transmission to traffic data process units assigned individually to a locally limited group of traffic signals, and the local traffic situation is analyzed in each traffic data processing unit for the environment of the respective assigned, locally limited group of traffic signals up to at the most the neighboring, locally limited groups of traffic signals.

A locally limited group of traffic signals may be formed by one or more traffic signal. If the group is formed by only one individual traffic signal, the local limitation is provided by the traffic signal itself. However, if the group is formed by multiple traffic signals, the local limitation of the group is defined by the mutual functional dependence of the traffic signals. For example, more than one street light is usually installed at an intersection of roads. There is usually at least one street light per direction of travel. However, these traffic lights cannot be switched independently of one another, and instead there is a mutual functional dependence among them. For example, only certain directions of travel may be released at the same time at an intersection, while others must be blocked during the same period of time. All the traffic lights at one such intersection thus form a locally limited unit of traffic signals, whose switching cycles have a mutual functional dependence. The same thing may also apply, for example, to successive speed limits or no-passing zones along a section of road or for signal equipment on railway sections or waterways, where the signal status of one traffic signal necessarily determines the signal status of another traffic signal, and thus there is a comparable mutual functional dependence of the traffic signals.

Therefore, this eliminates the need for a complex hierarchical structure with complicated central traffic data processing units, in contrast with the state of the art. Instead, traffic data is processed as much as possible in a decentralized manner and individually for the environment of each individual, locally limited group of traffic signals. The area of the environment to be considered per locally limited group of traffic signals is limited at the maximum end by neighboring locally limited groups of traffic signals, because these in turn perform their own local traffic data processing and analysis of the traffic situation. Such a decentralized method may be implemented by simpler decentralized processing equipment. The susceptibility of such a decentralized system to errors is also lower, because in the event of failure of one processing unit, the result is only a local system failure, in contrast with the risk of failure of the system as a whole, which may occur with the state of the art.

Specifically, it is possible to provide for an analysis of the local traffic situation to be performed only within the reception range of a transceiver unit of the traffic data processing units. Only the traffic data which can be received directly by the traffic data processing unit via the respective transceiver unit is taken into account.

As an alternative, however, it is also possible for the local traffic situation to be analyzed within an area extending beyond the reception range of a transceiver unit of the traffic data processing units. The traffic data required for analysis is relayed from the sending vehicles to the transceiver units of the traffic data processing units via additional transceiver units.

An implementation with the help of an ad hoc network may also be provided for this case in particular, whereby all the transceiver units of the network may be used as network nodes for relaying information to be transmitted. Each transceiver unit may thus also function as a communication device. Such networks may be organized ideally through a suitable design of the transceiver units themselves. The transceiver units used for relaying communications may be installed either in vehicles or in a stationary mount. In this way, traffic data originating from vehicles outside the reception range of the transceiver unit of the traffic data processing units may be relayed to a traffic data processing unit over multiple network nodes (multi-hop). It is also possible in this way to implement a data exchange among multiple locally limited groups of traffic signals; this may be helpful in controlling the traffic signals or for the local analysis of the traffic situation.

It is also possible to provide for detection and/or transmission of some or all of the relevant traffic data of a vehicle to a traffic data processing unit to be triggered when the vehicle has reached a defined position, i.e., a type of virtual position sensor. This defined position is determined by the corresponding traffic data processing unit, and the corresponding information is transmitted to at least one vehicle by wireless transmission.

Through on-board position determining devices such as wheel sensors, GPS or the like, the vehicle may then determine whether it has reached a defined position, and it may begin with the detection and/or transmission of traffic data when there is a correspondence between the defined position and the current position. The defined position may be established dynamically in particular as a function of the current traffic situation.

As an alternative or in addition to the above-mentioned method, it is also possible to provide for a transmission of certain or all relevant traffic data to take place continuously through all vehicles, and for processing of all received traffic data for analysis of the local traffic situation to take place in the traffic data processing units. For example, only a portion of the traffic data may be acquired and/or transmitted as a function of the position of the vehicle, while other traffic data may be acquired continuously and independently of defined vehicle positions. However, it is essentially also possible to omit position-dependent detection and/or transmission of data.

To do justice to the special needs of special vehicles such as police, emergency vehicles and the like in particular, it is possible for different types of vehicles to be prioritized in the traffic data processing units on the basis of the received traffic data, and locally limited groups of traffic signals may be controlled by taking into account the priority of vehicles in the environment of the locally limited group of traffic signals. The control may thus take place in such a manner that through traffic is immediately enabled along the route of the emergency vehicles, but through traffic is blocked for the other vehicles. However, it is also possible to block through traffic for all vehicles within the environment of emergency vehicles if this would be more advantageous, so that normal traffic comes to a standstill, and there are no longer any traffic movements that would interfere with the emergency vehicle.

Finally, it is also possible to provide for driver assistance information and/or vehicle control information to be created and transmitted to the vehicles by the traffic data processing units, this information being based on an analysis of the local traffic situation and/or the control status of the locally limited group of traffic signals. Driver assistance information is understood to refer to information which provides the driver with additional information for driving his vehicle and/or evaluating the traffic situation. With the help of vehicle control information, however, it is possible to intervene directly in the operating state and control of a vehicle, e.g., by automatically reducing a vehicle's speed in its approach to a red light or to an emergency vehicle.

Another object of an embodiment of the present invention is an arrangement for controlling a system of multiple traffic signals based on traffic data acquired by vehicles. This arrangement includes traffic data processing units as well as transceiver units which are connected to the traffic data processing units. In addition, the arrangement includes devices for analyzing the traffic situation and the traffic data processing units and finally also devices for controlling the traffic signals based on the results of this analysis. In accordance with the embodiment, one traffic data processing unit is provided individually for a locally limited group of traffic signals, and each traffic data processing unit is designed for analyzing the local traffic situation for the environment of the respective locally limited group of traffic signals up to at the most the neighboring locally limited group of traffic signals. Thus, a system is defined which is organized decentrally as much as possible, with self-contained units being defined for each locally limited group of traffic signals for processing and analysis of traffic data, by way of which local traffic analyses are performed in the immediate environment of a locally limited group of traffic signals. The advantages obtained from such a decentralized system correspond to those already explained in conjunction with the method described above.

A locally limited group of traffic signals may also be formed here by one or more traffic signals. If the group is formed by only one traffic signal, the local limitation is determined by the traffic signal itself. However, if the group is formed by multiple traffic signals, the local limitation of the group for this object of an embodiment of the invention is also defined by the mutual functional dependence of the traffic signals. It is again pointed out here as an example that usually at least one traffic light is provided for each direction of travel at an intersection of roads, and one traffic light cannot be switched independently of the others. Instead, they have a mutual functional dependence, as already explained above. Thus, all the traffic lights of such an intersection form a locally limited unit of traffic signals, whose switching cycles have a mutual functional dependence. The same thing can also be said of this object of the invention, e.g., successive speed limits or no-passing zones along a section of roadway or for signal devices on railway segments or waterways, whereby the signal status of one traffic signal necessarily determines the signal status of another traffic signal, and thus there is a comparable mutual functional dependence of the traffic signals.

To implement the acquisition or transmission of traffic data as a function of vehicle positions, the traffic data processing unit in particular may have devices for detecting defined vehicle positions as the triggering device for the acquisition and/or transmission of traffic data of a vehicle to a traffic data processing unit. Thus, instead of stationary sensors in the area of the traffic routes (e.g., induction loops) such as those known from the state of the art, dynamically adaptable "virtual position sensors" may also be defined as triggering devices.

If the special needs of special vehicles such as police, fire department and the like are to be taken into account, it is possible to provide for the traffic data processing unit to have a device for prioritizing the different types of vehicles on the basis of received traffic data as well as a device for controlling the locally limited group of traffic signals by taking into account the priority of the vehicles in the environment of the locally limited group of traffic signals. It is then possible to derive instructions for the type of vehicles located in the environment of the locally limited group of traffic signals from the received traffic data and then to prioritize the vehicles on the basis of this information. Thus, in particular, the traffic signals may be controlled in such a manner that unimpeded through traffic is guaranteed as much as possible for special vehicles.

Finally, each traffic data processing unit may have a device for generating driver assistance information and/or vehicle control information for the vehicles. It is thus possible on the one hand to provide helpful information to the occupants of the vehicles, in particular the drivers, while on the other hand, direct intervention in control of the vehicle may also be possible, e.g., externally controlled regulation of vehicle speed in approach to a traffic signal or in the event of a hazard.

All the devices mentioned above may in principle be implemented through separate, appropriately adapted physical technical units. However, one physical unit may also replace several tasks and therefore logically may combine several of the aforementioned devices in one. In any case, however, this preserves the decentralized design of the system based on the principle of local traffic data processing and analysis for a locally limited group of traffic signals.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
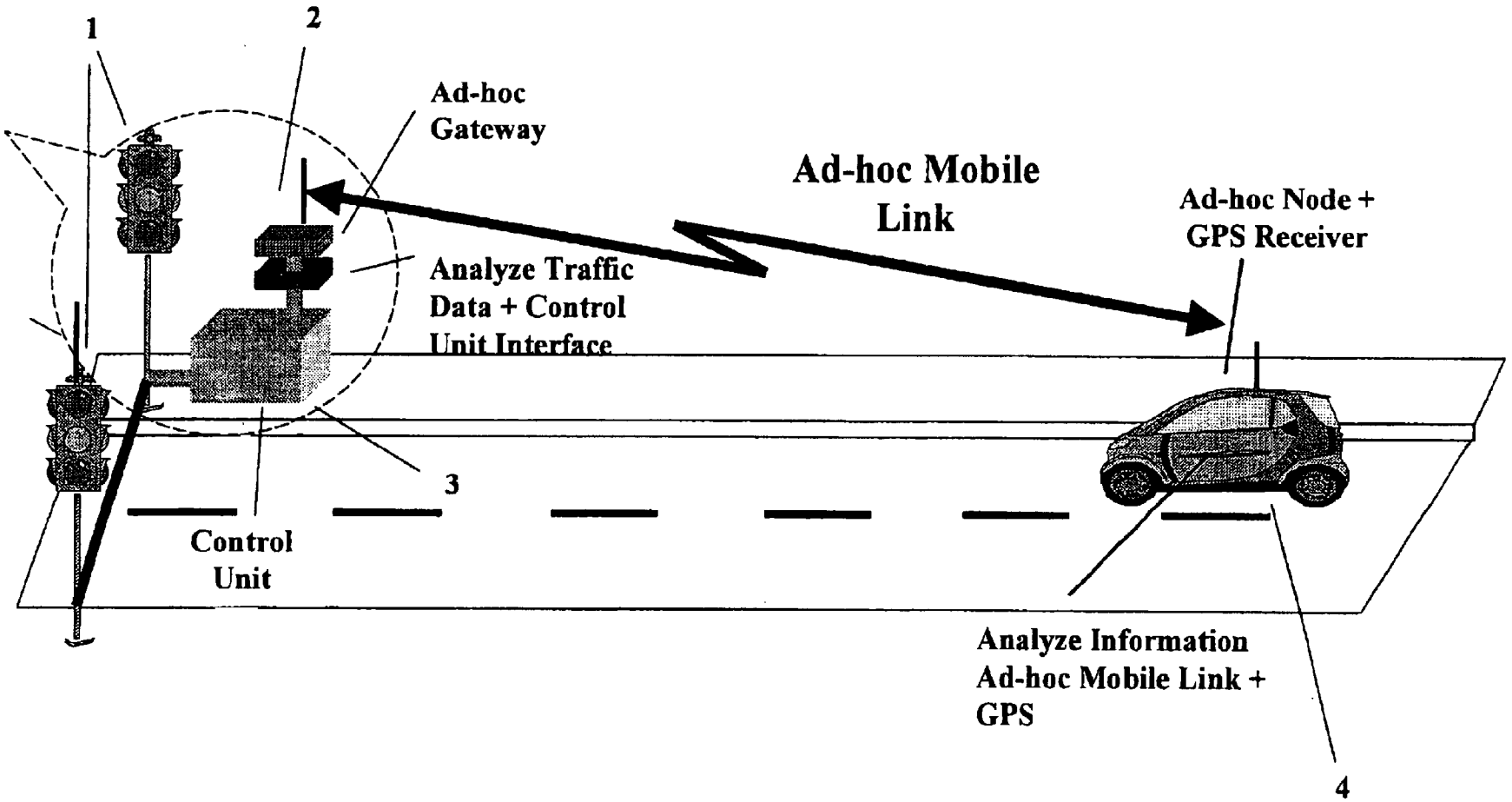
FIG. 1 illustrates a schematic diagram of local traffic data acquisition according to this invention.

FIG. 1 shows schematically the principle of the control of traffic signals 1 according to an embodiment of the present invention on the basis of traffic data acquisition and analysis of the traffic situation on the basis of a specific example. Traffic signals 1 are designed here as traffic lights, which are located at an intersection of roads. Usually not just one single traffic light 1 is provided at such an intersection, but instead at least one traffic light 1 will be provided there for each direction of travel. The switching phases of these traffic lights 1 must necessarily be coordinated, so that traffic lights 1 at this intersection form a locally limited group of mutually functionally dependent traffic signals 1. For the case when a single traffic light 1 is sufficient, the following is also applicable accordingly, whereby instead of referring to a locally limited group of traffic lights 1, the discussion refers to only a single traffic light 1.

A transceiver unit 2 (ad hoc gateway) is assigned individually to the traffic lights 1 of this group and is in turn connected individually to a traffic data processing unit 3 (control unit interface) which performs an analysis of traffic data (analyze traffic data) and performs a control (control unit) of the traffic lights 1 of the locally limited group on the basis of the results of this analysis. Thus, precisely one traffic data processing unit 3 and precisely one transceiver unit 2 are provided for each locally limited group. With these components, a local analysis of the traffic situation may be performed for the environment around traffic lights 1. Traffic data processing unit 3 may additionally be designed as a gateway to a data network (backbone network) from which data for additional services such as general traffic information can be received and relayed further to vehicles 4 via the traffic data processing unit 3 and the respective transceiver unit 2.

Regarding the local analysis of the traffic situation and optionally the data transmission to vehicles 4, a wireless connection (mobile ad hoc link) to vehicles 4 in the environment of the transceiver is established to permit a data exchange with these vehicles 4. Vehicles 4 likewise have transceiver units (ad hoc nodes) for this purpose. In addition, vehicles 4 are equipped with devices for position determination, namely a GPS receiver in the example according to FIG. 4. In vehicle 4, the information from the GPS receiver is analyzed (analyze GPS information) and transmitted via wireless transmission to the traffic data processing unit 3. Additional information may also be transmitted here to the traffic data processing unit 3, such as the type of vehicle, the operating status of the vehicle and speed information, and ambient information, e.g., from vehicle sensors, or the status of certain automotive devices may also be obtained (lights on=impaired visibility, windshield wipers on=rain). If vehicle 4 has received additional information from the traffic data processing unit 3 by wireless transmission, this information is also analyzed in vehicle 4 (analyze information by mobile ad hoc link).

The traffic data transmitted from vehicle 4 to traffic data processing unit 3 is analyzed in traffic data processing unit 3 to obtain a picture of the local traffic situation for the environment of the traffic data processing unit 3, i.e., for the environment around the respective traffic lights 1. Targeted control of traffic lights 1 may then be implemented by traffic data processing unit 3 on the basis of the results of the analysis of the local traffic situation, e.g., optimized release of certain directions of travel through appropriately adapted green light phases of traffic lights 1. The current or preceding switching phases of traffic lights 1 may in turn be transmitted as information to vehicles 4, so that knowledge of these signal phases in vehicles 4 is improved.

This system has the advantage that it can be installed without any great complexity and does not require any complicated hierarchical structures; furthermore, it is easily adaptable dynamically to current prevailing conditions. In particular, this eliminates the need for road surface sensors such as induction loops which are embedded in the road surface and are complicated and require frequent repairs. Instead, to permit installation of such a system, all that is needed here is an electric power supply, which is available anyway in the case of electrically operated traffic signals.

In FIGS. 2 through 5, the individual devices assigned to traffic lights 1, 11 are not shown separately for reasons of simplicity, but instead only traffic lights 1 are shown here. However, the function principle presented in FIG. 1 should also be assumed to apply to these figures as well as the respective embodiment, i.e., a traffic data processing unit 3 (not shown explicitly) with the respective transceiver unit is assigned individually to each traffic light and/or each locally limited group of traffic lights, as illustrated on the basis of FIG. 1.

Figure 2:
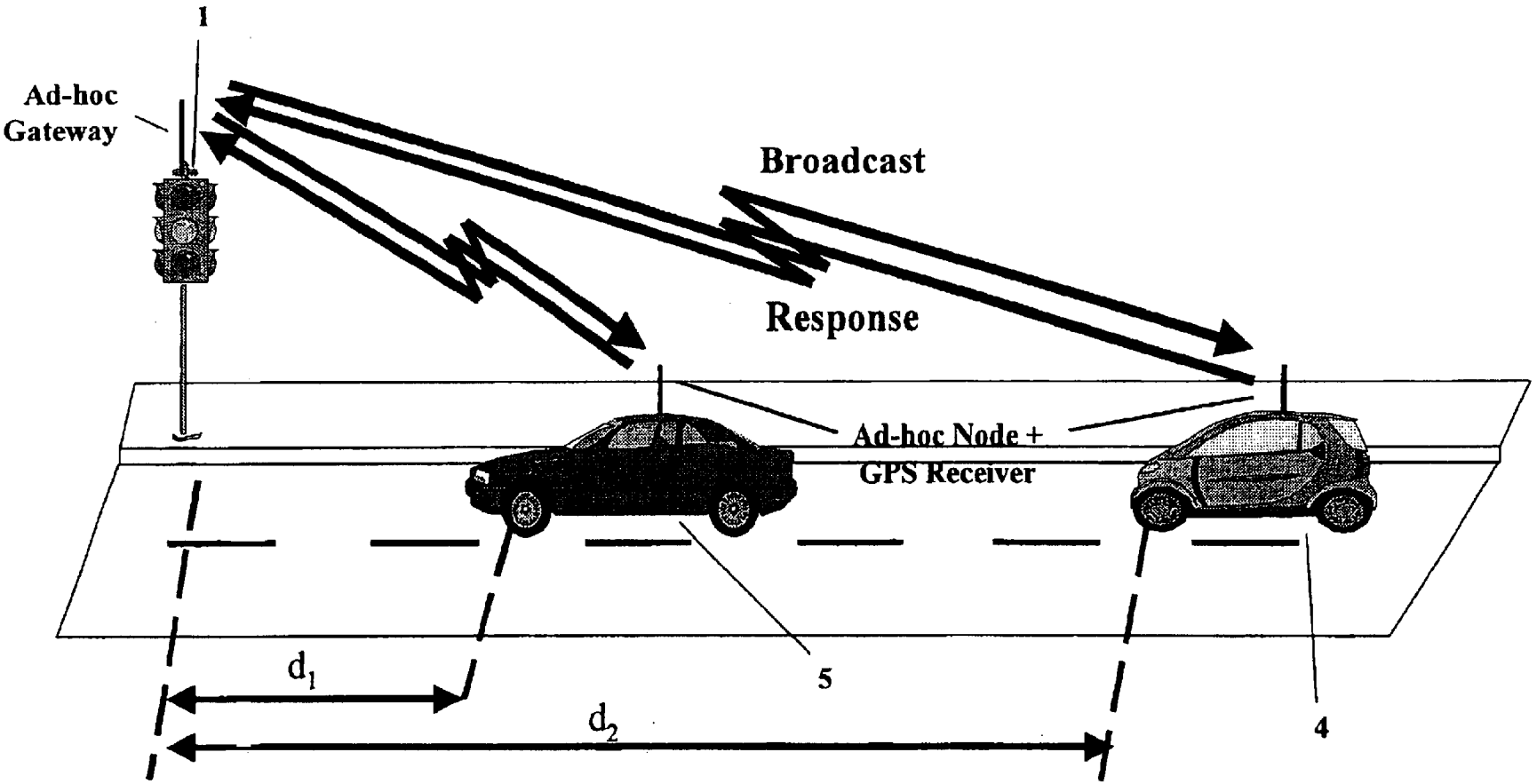
FIG. 2 illustrates a diagram of traffic data acquisition according to FIG. 1 for multiple vehicles in particular as a function of vehicle position.

The acquisition and/or transmission of traffic data by vehicles 4, 5 may also take place as a function of position by the fact that certain positions are determined by traffic data processing unit 3 as relative distances d1, d2 from traffic lights 1 or in absolute coordinates, for example, i.e., as a type of "virtual contact loop." This possibility is illustrated schematically in FIG. 2. Vehicles 4, 5 can determine with the help of the GPS receiver whether and when they have reached the position defined by traffic data processing unit 3. For example, vehicle 4 may transmit initial traffic data (response) to traffic data processing unit 3 on reaching the first position, defined by distance d2, and communicated to the vehicle by wireless transmission (broadcast). This traffic data may then be used as preliminary information, for example, for traffic data processing unit 3 for long-term planning of the control of traffic lights 1. Vehicle 5 has already reached a second position, which is defined by distance d1. Vehicle 5 has already been notified of this position previously by wireless transmission. Additional traffic information, which may be used for direct control of traffic lights 1, for example, is transmitted by vehicle 5 to traffic data processing unit 3.

The definition of the number and location of these positions can be adapted dynamically by traffic data processing unit 3 to the respective traffic situation. For example, when traffic is minimal, distances d1, d2 may be increased, and when traffic is heavy, they may be reduced. However, distance d2 may also be adapted based on the last vehicle 4 in a queue, where the end of the queue can be determined by the traffic data transmitted to the traffic data processing unit 3 if this data also contains speed information on vehicles 4, 5.

For the case when no traffic data can be received by vehicles 4, 5, e.g., when there are no vehicles 4, 5 in the environment of traffic lights 1 or there is a disturbance in the wireless connection between transceiver unit 2 and vehicles 4, 5, it is possible to rely on other data for controlling traffic lights 1, which may be called up via the ad hoc gateway and backbone data network, for example, or a standard method of controlling traffic lights 1 may be implemented by the traffic data processing unit 3, providing for periodic switching phases of the same duration for all the respective traffic lights 1, for example. As soon as traffic data is again being received by the vehicles, traffic data processing unit 3 may switch back to controlling traffic lights 1 on the basis of an analysis of this traffic data.

Figure 3:
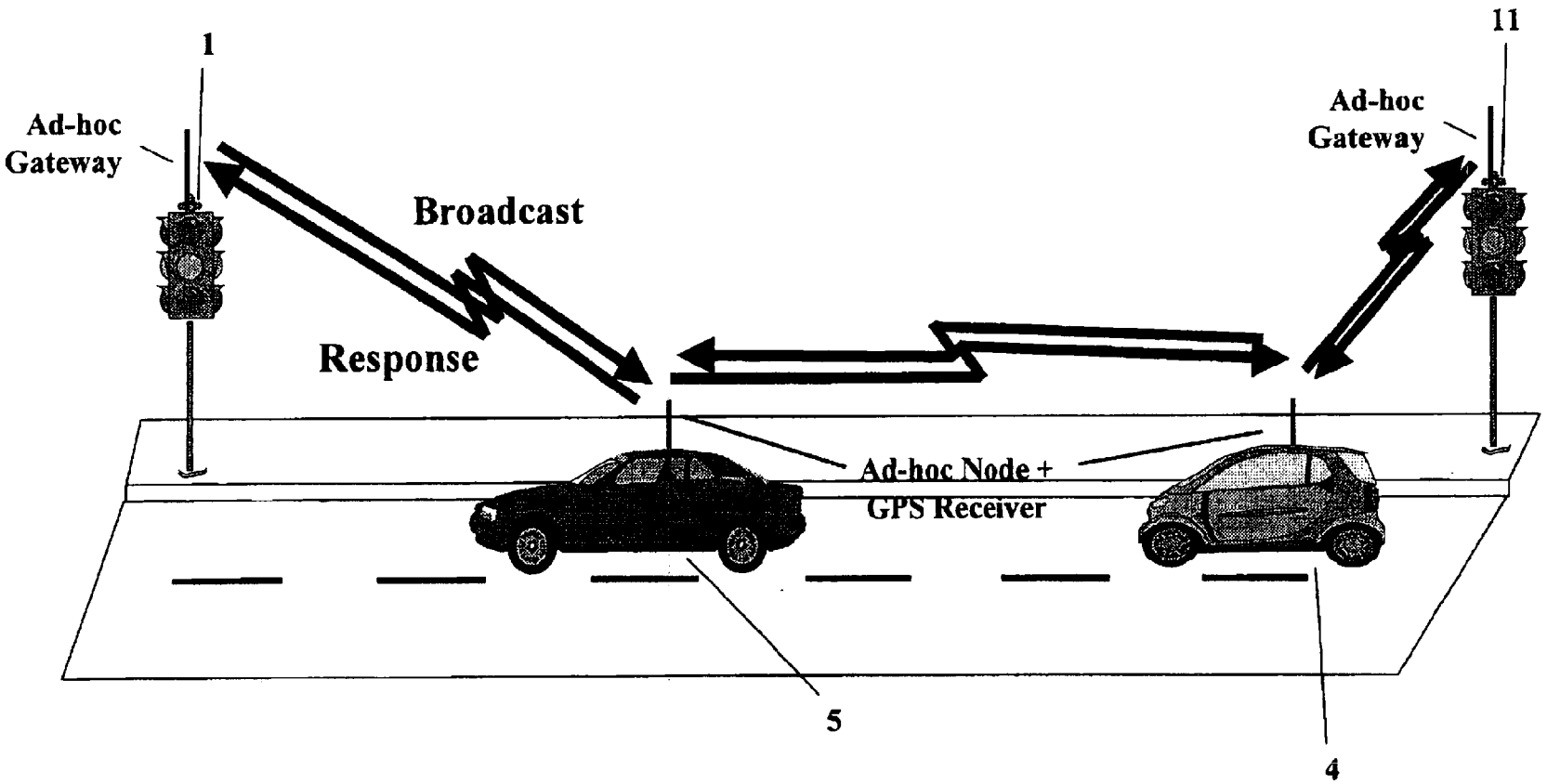
FIG. 3 illustrates a diagram of a traffic data transmission over multiple nodes of an ad hoc wireless system.

It is possible in principle to provide for only traffic data sent by vehicles within the direct reception range of transceiver unit 2 to be taken into account. This could be implemented by any suitable type of wireless communication system. However, if an ad hoc system is selected as the wireless communication system, such traffic data originating from vehicles or from other devices outside of the direct reception range of transceiver unit 2 may also be taken into account in a simple manner. This is illustrated in FIG. 3. In an ad hoc system, each ad hoc node may be used as a communication device for relaying received data. Data may thus be relayed via multiple ad hoc connections with the help of multiple ad hoc nodes (multi-hop). An ad hoc wireless communication system is thus a self-organizing system which can function without the central network infrastructure of conventional wireless communication systems.

Such an ad hoc communication system may thus be used to make information accessible to traffic data processing unit 3 beyond the reception range of the transceiver unit. This information may originate from other vehicles 4, as mentioned above, but it may also come from stationary devices such as additional traffic signals 11 or other information gateways of service providers or the like, which are designed as ad hoc nodes. Traffic lights 1 may thus exchange data with additional traffic lights 11 and may thus be integrated into a larger, more global system of traffic signals.

Figure 4:
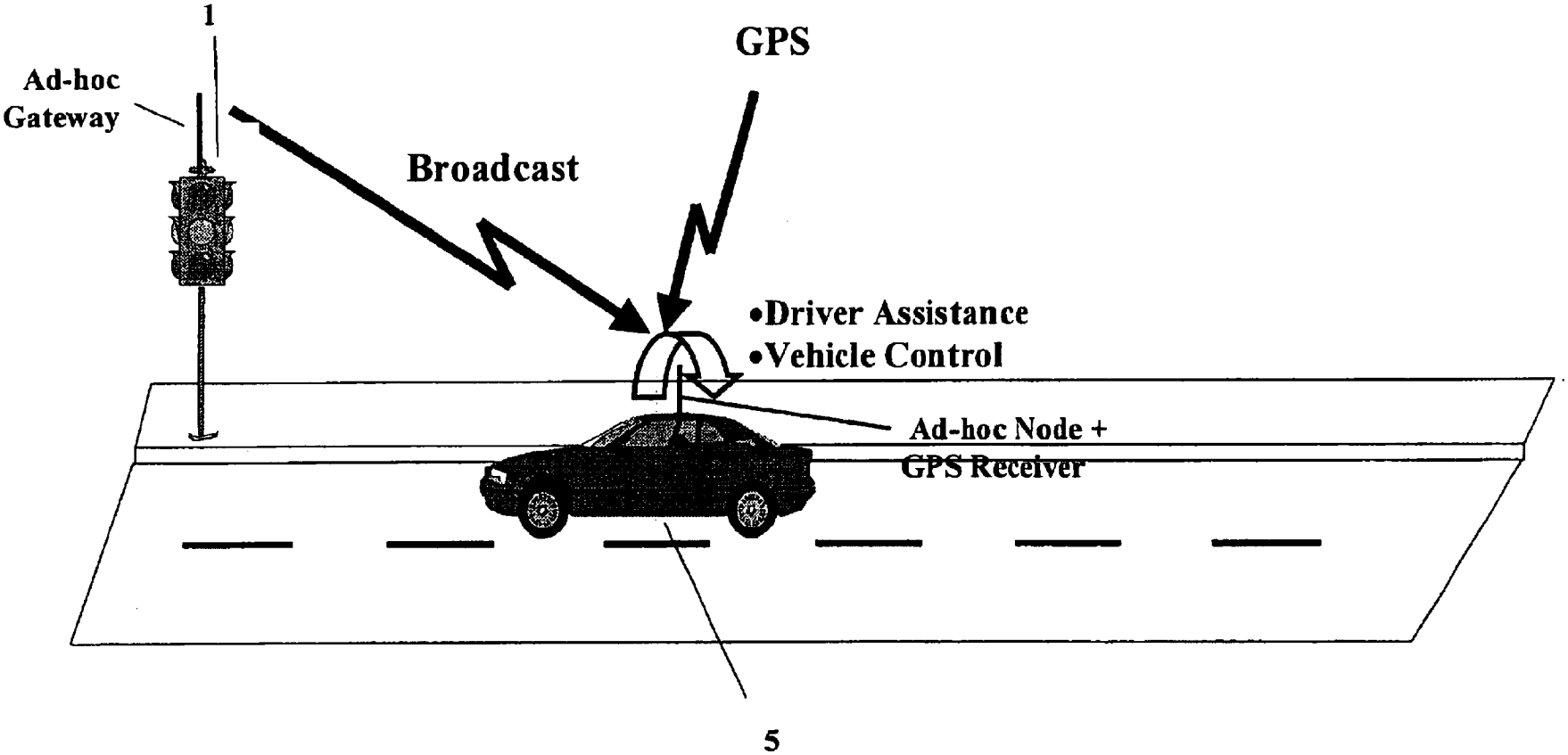
FIG. 4 illustrates a diagram of transmission of driver assistance information and vehicle control information to a vehicle.

FIG. 4 shows a schematic diagram of a refinement of this invention which offers the driver additional assistance in driving his vehicle 5. Driver assistance information and/or vehicle control information is transmitted to the vehicle 5 by wireless transmission (broadcast) from the traffic data processing unit 3 of traffic light 1. Vehicle 5 in turn always determines its current position by GPS.

The driver assistance information includes data which only provides additional information for the driver of vehicle 5 or optionally other occupants of the vehicle for driving vehicle 5, e.g., information regarding the status of traffic light 1, e.g., the location, direction of travel currently enabled, the length of time until the next phase change of the signaling phases of traffic lights 1, the duration of the current signaling phase or the immediately preceding signaling phase, etc. In addition, information regarding the result of the analysis of the local traffic situation in the environment of traffic lights 1 may also be transmitted, such as information regarding a queue, images of the respective intersection and/or cross streets or the approach of special vehicles. A vehicle equipped with an ad hoc wireless node may thus warn the driver before crossing an intersection when the light is red based on an analysis of the driver assistance information as well as the data of a GPS receiver or comparable position sensors and optionally with the inclusion of data from other sensors such as speed sensors, or it may specify for the driver a guideline speed, which would guarantee the most constant possible traffic flow, avoiding red light phases of traffic lights 1, and would thus reduce acceleration or deceleration of vehicle 5 to a minimum. Essentially other data such as information from other service providers, additional services, entertainment and multimedia data may also be transmitted to vehicle 5.

The vehicle control information is used for active intervention into the functioning and operating status of the vehicle in particular in hazardous situations or emergency situations. For example, when vehicle 5 approaches a red traffic light 1 or when special vehicles are approaching, the speed of vehicle 5 may be reduced automatically for safety reasons based on such vehicle control information.

Figure 5:
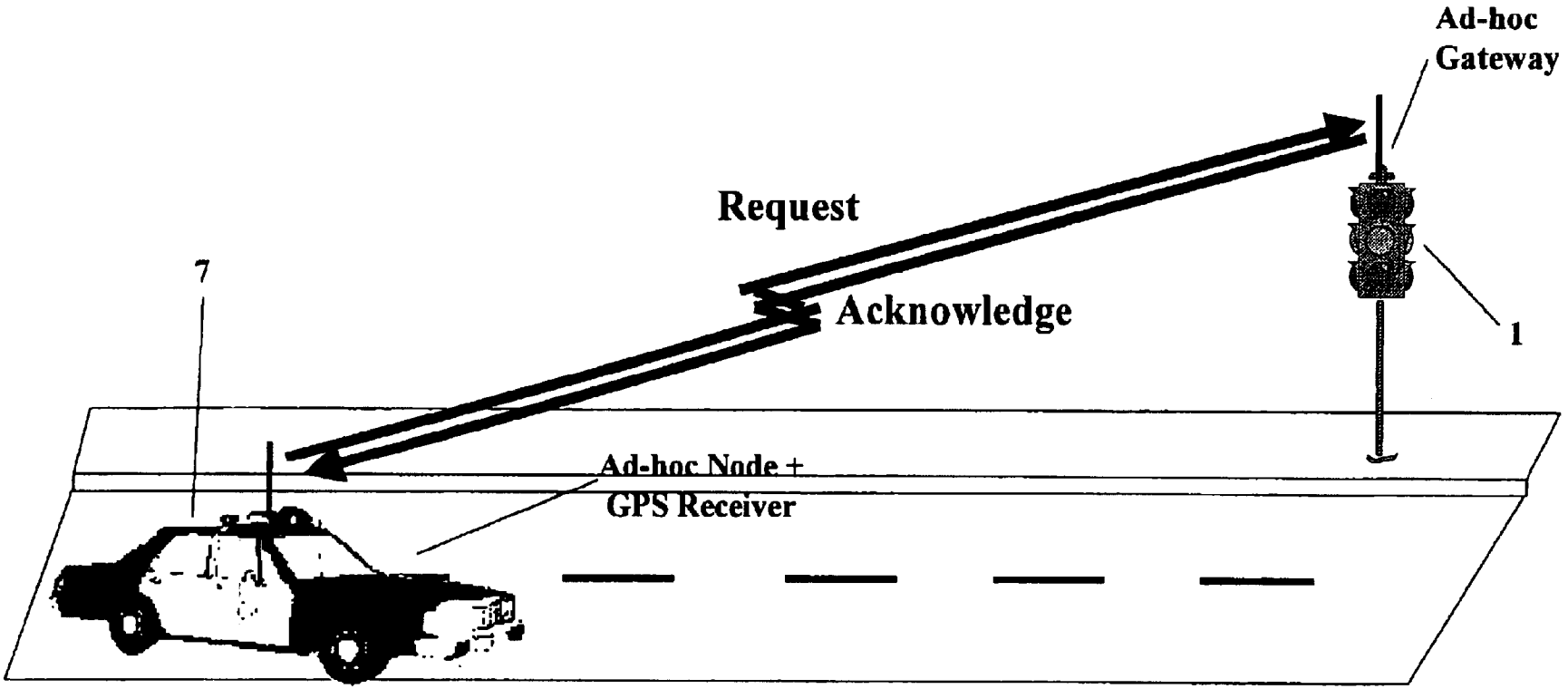
FIG. 5 illustrates a diagram of a traffic signal control on the basis of prioritization of vehicles.

FIG. 5 shows another refinement of this invention which takes into account the special needs of special vehicles 7 such as police, fire department, ambulances and the like. Such vehicles transmit data (requests) to traffic light 1 and/or to traffic data processing unit 3, including a specific characterization of vehicle 7 as a special vehicle. Optionally the transmitted data may also contain an explicit request for enabling the corresponding direction of travel. To guarantee that traffic data processing unit 3 will in fact coordinate the control of traffic lights 1 in response to the request by special vehicle 7, a confirmation (acknowledgment) of receipt of data may be transmitted by wireless transmission to the special vehicle 7 in particular.

On the basis of the received data, traffic data processing unit 3 may prioritize the vehicles in the environment of traffic lights 1, assigning the highest priority to special vehicles 7, and thus preferentially enabling the corresponding direction of travel for these vehicles. In addition, it is also possible to provide for information regarding the result of the analysis of the local traffic situation in the environment of traffic lights 1 to be transmitted to the special vehicle 7, e.g., information regarding a queue, images of the respective intersection and/or cross streets. Therefore, the risk of accidents for special vehicles 7, which must usually move forward at a relatively high speed because of the given emergency situation, can be greatly reduced in their approach to traffic signals and at intersections in particular, and unhindered progress of these vehicles can be guaranteed as much as possible.

To prevent unauthorized parties from gaining access to the control of traffic lights 1 according to the method illustrated in FIG. 5, suitable safety measures may be provided to ensure that such far-reaching access is allowed only for special vehicles 7 or other vehicles with an equally high priority. In this regard, safety mechanisms such as encryption or access codes may be provided as part of the ad hoc wireless system, and this information made available only to suitably prioritized vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a system of multiple traffic signals for regulating the traffic of motor vehicles, comprising:

acquiring traffic data using vehicles;

transmitting the traffic data at least partially by wireless transmission to traffic data processing units;

analyzing a traffic situation in the traffic data processing units; and controlling the traffic signals on the basis of a result of the analysis;

wherein the traffic data is transmitted by wireless transmission to the traffic data processing units being assigned individually to locally limited groups of traffic signals;

wherein each traffic data processing unit analyzes a local traffic situation for an environment of a respective locally limited group of traffic signals, the environment being limited by an area that extends up to, at a maximum, neighboring locally limited groups of traffic signals; and wherein analysis of the local traffic situation is performed within a region which extends beyond the reception range of a transceiver unit of the traffic data processing unit, the traffic data required for the analysis being relayed from transmitting vehicles to the transceiver units of the traffic data processing unit via additional transceiver units.

2. The method according to claim 1, wherein the traffic data is relayed by transceiver units of other vehicles.

3. The method according to claim 2, wherein acquisition or transmission of traffic data of a vehicle to a traffic data processing unit is triggered when the vehicle reaches a defined position, the defined position being determined by a corresponding traffic data processing unit, and a corresponding information is transmitted by wireless transmission to at least one vehicle.

4. The method according to claim 2, wherein traffic data is transmitted continuously by all vehicles and all the received traffic data is processed in the traffic data processing units for analysis of the local traffic situation.

5. The method according to claim 1, wherein acquisition or transmission of traffic data of a vehicle to a traffic data processing unit is triggered when the vehicle reaches a defined position, the defined position being determined by a corresponding traffic data processing unit, and a corresponding information is transmitted by wireless transmission to at least one vehicle.

6. The method according to claim 1, wherein traffic data is transmitted continuously by all vehicles arid all the received traffic data is processed in the traffic data processing units for analysis of the local traffic situation.

7. A method of controlling a system of multiple traffic signals for regulating the traffic of motor vehicles, comprising:

acquiring traffic data using vehicles;

transmitting the traffic data at least partially by wireless transmission to traffic data processing units;

analyzing a traffic situation in the traffic data processing units; and controlling the traffic signals on the basis of a result of the analysis;

wherein the traffic data is transmitted by wireless transmission to the traffic data processing units being assigned individually to locally limited groups of traffic signals;

wherein each traffic data processing unit analyzes a local traffic situation for an environment of a respective locally limited group of traffic signals, the environment being limited by an area that extends up to, at a maximum, neighboring locally limited groups of traffic signals; and wherein acquisition or transmission of traffic data of a vehicle to a traffic data processing unit is triggered when the vehicle reaches a defined position, the defined position being determined by the corresponding traffic data processing unit, and a corresponding information is transmitted by wireless transmission to at least one vehicle.

8. The method according to claim 7, wherein the defined position is set dynamically as a function of a current traffic situation.

9. The method according to claim 7, wherein vehicle types are prioritized in the traffic data processing units on the basis of the received traffic data, and the locally limited group of traffic signals is controlled by taking into account the priority of the vehicles in the environment of the locally limited group of traffic signals.

10. A method of controlling a system of multiple traffic signals for regulating the traffic of motor vehicles, comprising:

acquiring traffic data using vehicles;

transmitting the traffic data at least partially by wireless transmission to traffic data processing units;

analyzing a traffic situation in the traffic data processing units; and controlling the traffic signals on the basis of a result of the analysis;

wherein the traffic data is transmitted by wireless transmission to the traffic data processing units being assigned individually to locally limited groups of traffic signals;

wherein each traffic data processing unit analyzes a local traffic situation for an environment of a respective locally limited group of traffic signals, the environment being limited by an area that extends up to, at a maximum, neighboring locally limited groups of traffic signals; and wherein the traffic data processing units generate and transmit driver assistance information and vehicle control information to the vehicles, the information being based on the analysis of the local traffic situation or a status of the control of the locally limited group of traffic signal

11. An arrangement for controlling a system of multiple traffic signals on the basis of traffic data acquired by vehicles, comprising:

individual traffic data processing units being assigned to a locally limited group of traffic signals;

wherein each traffic data processing unit analyzes a local traffic situation for an environment of a respective locally limited group of traffic signals, the environment being limited by an area that extends up to, at a maximum, neighboring locally limited groups of traffic signals; and wherein each traffic data processing unit has devices for establishing defined vehicle positions as a triggering technology for acquisition and transmission of traffic data of a vehicle to a traffic data processing unit.

12. The arrangement according to claim 11, wherein the traffic data processing units have a device for prioritizing different types of vehicle on the basis of received traffic data as well as a device for controlling the locally limited group of traffic signals taking into account a priority of the vehicles in the environment of the locally limited group of traffic signals.

13. An arrangement for controlling a system of multiple traffic signals on the basis of traffic data acquired by vehicles, comprising:

individual traffic data processing units being respectively assigned to locally limited groups of traffic signals;

wherein each traffic data processing unit analyzes a local traffic situation for an environment of a respective locally limited group of traffic signals, the environment being limited by an area that extends up to, at a maximum, neighboring locally limited groups of traffic signals; and wherein the traffic data processing units have a device for generating driver assistance information and vehicle control information for the vehicles.

* * * * *